US008857677B2

(12) United States Patent
Gouldson

(10) Patent No.: US 8,857,677 B2
(45) Date of Patent: Oct. 14, 2014

(54) LOWER NECK INDICATOR FOR WIRE HOOK HANGERS

(71) Applicant: Braiform Group Pty Ltd, Carrum Downs (AU)

(72) Inventor: Stanley F. Gouldson, Hauppauge, NY (US)

(73) Assignee: Spotless Plastics Pty Ltd., Victoria (AU)

( * ) Notice: Subject to any disclaimer, the term of this patent is extended or adjusted under 35 U.S.C. 154(b) by 0 days.

(21) Appl. No.: 14/066,161

(22) Filed: Oct. 29, 2013

(65) Prior Publication Data

US 2014/0048571 A1 Feb. 20, 2014

Related U.S. Application Data

(63) Continuation of application No. 13/339,924, filed on Dec. 29, 2011, now Pat. No. 8,596,503, which is a continuation of application No. 12/395,834, filed on Mar. 2, 2009, now Pat. No. 8,113,392, which is a continuation of application No. 11/373,027, filed on Mar. 10, 2006, now Pat. No. 7,516,875.

(60) Provisional application No. 60/661,588, filed on Mar. 14, 2005.

(51) Int. Cl.
*A41D 27/22* (2006.01)
*A47G 25/14* (2006.01)

(52) U.S. Cl.
CPC ..... *A47G 25/1428* (2013.01); *A47G 25/1407* (2013.01); *A47G 25/1421* (2013.01)
USPC ..... 223/85; 40/322

(58) Field of Classification Search
USPC ..... 223/85, 88, 92, 95; 40/322; D6/328
See application file for complete search history.

(56) References Cited

U.S. PATENT DOCUMENTS

| | | | |
|---|---|---|---|
| 1,389,266 | A | 9/1921 | Newton |
| 1,544,844 | A | 7/1925 | Levkowits |
| 1,575,775 | A | 3/1926 | Lesser |
| 2,690,863 | A | 10/1954 | Adelman |
| 3,535,808 | A | 10/1970 | Morrish |
| 3,790,044 | A | 2/1974 | Verdile |

(Continued)

FOREIGN PATENT DOCUMENTS

| | | | |
|---|---|---|---|
| JP | 2004-404 | A | 1/2004 |
| TW | M291264 | Y | 6/2006 |
| TW | I294772 | B | 3/2008 |

OTHER PUBLICATIONS

Taiwanese Office Action dated Jan. 12, 2012 and Search Report dated Dec. 22, 2011 for Patent Application No. 095108598.

*Primary Examiner* — Nathan Durham
(74) *Attorney, Agent, or Firm* — Scully, Scott, Murphy & Presser, P.C.

(57) ABSTRACT

In a lower neck sizer for a garment hanger and a combination turnable wire hook hanger and lower neck sizer, the lower neck sizer includes a body dimensioned to generally surround a cylindrical projection and the support flanges adjacent to the body flange of the hanger, and an inwardly extending tab secured to the sizer body configured to engage the hanger at the lower neck region to resist removal. The lower neck sizer also has a discontinuity traversing the height of the body to facilitate mounting on the hanger.

14 Claims, 4 Drawing Sheets

(56) References Cited

U.S. PATENT DOCUMENTS

| | | | | | |
|---|---|---|---|---|---|
| 3,898,754 | A | | 8/1975 | Johansson | |
| 4,017,990 | A | | 4/1977 | Garrison | |
| 4,045,899 | A | * | 9/1977 | Richardson | 40/322 |
| 4,123,864 | A | | 11/1978 | Batts et al. | |
| 4,137,661 | A | | 2/1979 | Johansson | |
| 4,160,333 | A | | 7/1979 | Indelicato | |
| 4,198,773 | A | | 4/1980 | Batts et al. | |
| 4,322,902 | A | | 4/1982 | Lenthall | |
| 4,333,590 | A | * | 6/1982 | Princiotta | 223/85 |
| 4,679,340 | A | | 7/1987 | Johansson | |
| 4,881,836 | A | * | 11/1989 | Blanchard | 40/322 |
| 5,056,248 | A | | 10/1991 | Blanchard | |
| 5,289,956 | A | | 3/1994 | Petrou | |
| 5,499,466 | A | | 3/1996 | House | |
| 5,687,887 | A | | 11/1997 | Bnod et al. | |
| 6,019,261 | A | * | 2/2000 | Morgan et al. | 223/96 |
| D421,848 | S | | 3/2000 | Willardson | |
| D422,153 | S | | 4/2000 | Willardson | |
| D423,798 | S | | 5/2000 | Willardson | |
| D424,818 | S | | 5/2000 | Willardson | |
| D430,410 | S | | 9/2000 | Willardson | |
| D445,836 | S | | 7/2001 | Willardson | |
| 6,308,872 | B1 | | 10/2001 | Duerr et al. | |
| 6,409,057 | B1 | | 6/2002 | Kim | |
| D506,620 | S | | 6/2005 | Leung et al. | |
| D507,120 | S | | 7/2005 | Leung et al. | |
| D510,198 | S | | 10/2005 | Willardson | |
| 7,287,674 | B1 | * | 10/2007 | Sutton et al. | 223/85 |
| 2002/0095829 | A1 | | 7/2002 | I-wen | |
| 2006/0006204 | A1 | | 1/2006 | Mainetti | |

* cited by examiner

LOWER NECK INDICATOR FOR WIRE HOOK HANGERS

CROSS-REFERENCE TO RELATED APPLICATIONS

This present application is a continuation of co-pending U.S. patent application Ser. No. 13/339,924, filed on Dec. 29, 2011, which is a continuation of U.S. patent application Ser. No. 12/395,834, filed Mar. 2, 2009, which is a continuation of U.S. patent application Ser. No. 11/373,027, filed Mar. 10, 2006. Furthermore, the present application claims priority under 35 U.S.C. §119(e) of U.S. Provisional Patent Application Ser. No. 60/661,588, entitled "Lower Neck Indicator for Wire Hook Hangers", filed Mar. 14, 2005 by the present inventor and commonly assigned with the present application. The complete disclosure of these applications is hereby incorporated by reference for all purposes.

BACKGROUND OF THE INVENTION

1. Field of Invention

The present invention relates generally to the field of garment hangers, and more specifically to a lower neck indicator for use with a hanger having a wire metal hook.

2. Description of Related Art

In the area of retail garment sales, so-called Garment-On-Hanger (GOH) programs have become preferred by retailers. In a GOH program, garments are delivered to retail merchants already suspended from hangers, whereupon arrival at the retail location they may immediately be placed on display for sale. Formerly, retailers accomplished this task with labor provided at their own expense.

In particular, retailers have specified particular hangers or hanger characteristics among their several suppliers in order to achieve a visually pleasing uniformity on their sales floors. To this end, standards as to hanger size, shape, performance characteristics, etc., are maintained, for example, by organizations such as the Voluntary Inter-industry Commerce Standards Association (VICS). One particular standardized hanger feature is extremely popular across several hanger models, namely a turnable wire hook mated to a plastic hanger.

Additionally, and interrelated to the promulgation of GOH programs, retailers and their customers desire to have the hanger itself display some indicia regarding the item carried upon it. Categories of indicia could include manufacturer, material and price, but most notably for garments, their size. Various means for accomplishing this have been developed, including those disclosed in U.S. Pat. No. 5,884,422 to Marshal, et al., and U.S. Pat. No. 6,019,260 to Gouldson, both of which are commonly assigned with the instant application, among others. Popular among these are the type disclosed in the latter patent just mentioned, i.e., those that secure to the hanger adjacent the intersection of the hook and the hanger body to one side of the hook, appropriately called side-sizer tabs, or simply side-sizers; lower neck sizers or indications.

However, such side-sizers heretofore known in the art require that the hanger be specifically manufactured to accept the particular indicator. Various other indicators could be made universally adaptable, for example those attached surrounding the wire hook of the hanger. These generally are free to slide along the length of the wire hook, and ordinarily come to rest at the base of the hook adjacent the hanger body.

However, these do not securely engage with the hanger, nor achieve a desirable appearance.

BRIEF SUMMARY OF THE INVENTION

Therefore, in order to overcome these and other deficiencies in the prior art, provided according to the present invention is a lower neck sizer for a garment hanger and a combination turnable wire hook hanger and lower neck sizer. The turnable wire hook hanger includes a body having a body flange surrounding the body, a cylindrical projection extending from the body beyond the flange, a pair of support flanges extending between the cylindrical projection and the body flange, and a wire hook rotably received in the cylindrical projection. The lower neck sizer includes a body dimensioned to generally surround the cylindrical projection and the support flanges adjacent to the body flange, and an inwardly extending tab secured to the sizer body, the inwardly extending tab configured to engage the hanger at a lower neck region to resist removal of the lower neck sizer.

In a more particular embodiment, the inwardly extending tab comprises a relief sized to accommodate the cylindrical projection and a finger directed towards the intersection between one of the support flanges with the cylindrical projection when the lower neck sizer is engaged with the hanger at a lower neck region. Alternately, the inwardly extending tab comprises an upward surface located to engage the body flange. The lower neck sizer may include a downward extension, the inwardly extending tab being carried by the downward extension.

In another embodiment, the inwardly extending tab comprises a plurality of substantially radial projections located at an upper surface of the lower neck sizer and dimensioned to engage the wire hook. Each of the plurality of substantially radial projections may, but need not, have a convex, concave, chamfered or sloped inward end. The lower neck sizer can have a discontinuity traversing the height of the body to facilitate mounting on the hanger.

BRIEF DESCRIPTION OF THE DRAWINGS

These and other features, aspects and benefits of the present invention will be made apparent with reference to the following specification and accompanying drawings, where like reference numerals refer to like features across the several views, and wherein.

DETAILED DESCRIPTION OF THE INVENTION

Figure 1:
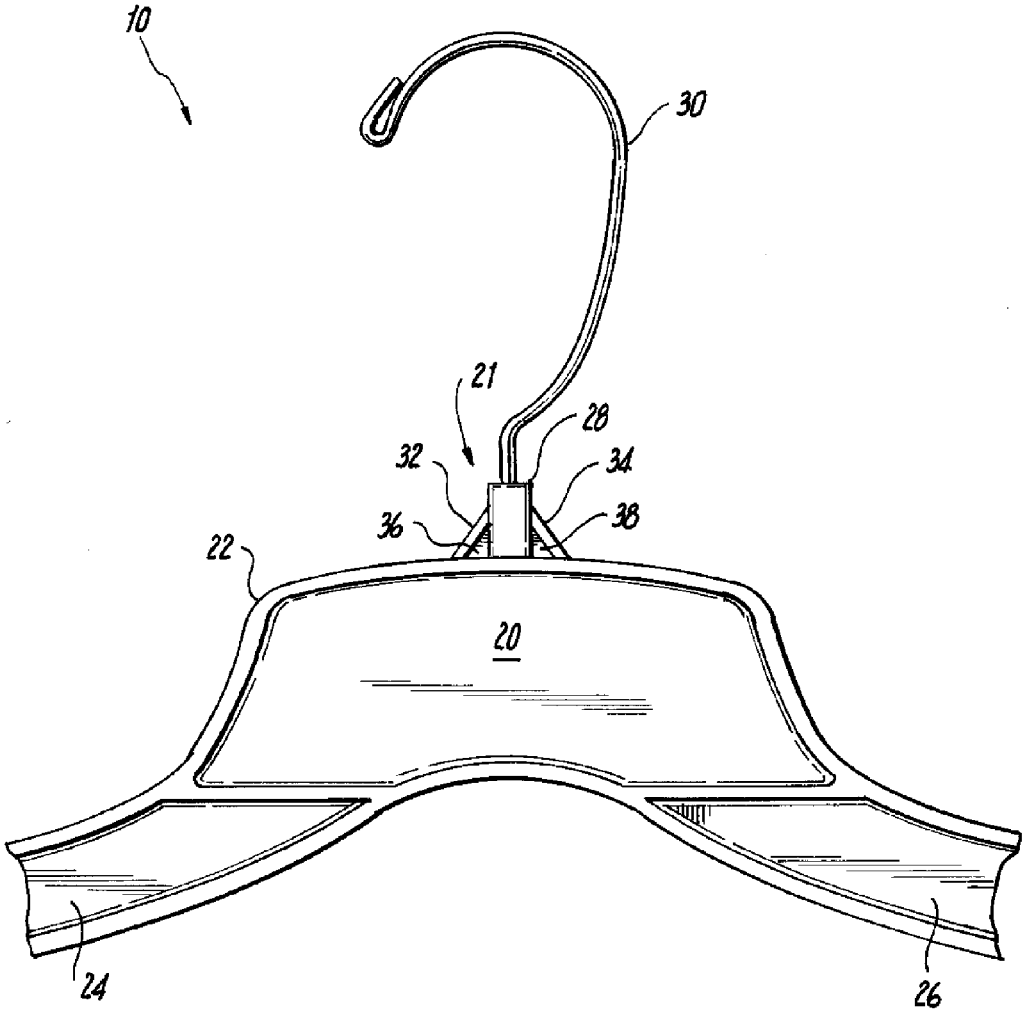
Fig. 1 (Prior Art)
FIG. 1 illustrates a partial cutaway view of a generic turnable wire hook hanger as is known in the art.

Referring now to FIG. 1, illustrated is a generic turnable wire hook hanger 10 as is known in the art. The hanger has a body 20, and wire hook 30 rotably mated to the body 20 at a region of the hanger referred to as the lower neck 21. The body 20 is generally planar and has a body flange 22 surrounding and defining it. Body flange 22 continues beyond body 20 to encircle and define left and right arms 24, 26, respectively. At the junction of the wire hook 30 and the body 20, a cylindrical projection 28 extends beyond the body 20 and body flange 22 to receive and capture the wire hook 30. Projection 28 is supported by first and second support flanges 32, 34, respectively. First and second support webs 36, 38, extend between first and second support flanges 32, 34, projection 28, and body flange 22, to fill the space and provide additional integrity.

Figure 2:
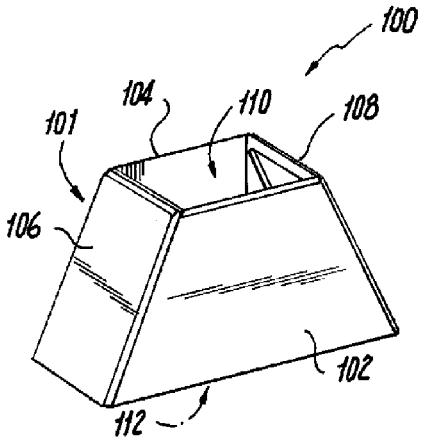
FIG. 2 illustrates, in perspective view, a lower neck sizer according to a first embodiment of the present invention.

Referring now to FIG. 2, illustrated in perspective view is a lower neck indicator or sizer, generally 100, according to a first embodiment of the present invention. The indictor is predominantly, but not exclusively, used to indicate the size of a garment to be suspended from the hanger the indicator is mounted on. Throughout the specification, the term sizer shall be used interchangeably with indicator, without regard to whether its indica relates to a size or any other characteristic. Lower neck sizer 100 has a body 101 including a generally trapezoidal anterior wall 102 and a generally trapezoidal posterior wall 104. Lateral walls 106 and 108 connect the anterior wall 102 and posterior wall 104. Lower neck sizer 100 has an at least partially open upper surface 110 and an at least partially open lower surface 112, both to admit the hook 30 and at least the latter to admit lower neck 21 for mounting and use of the lower neck sizer 100.

Figure 3:
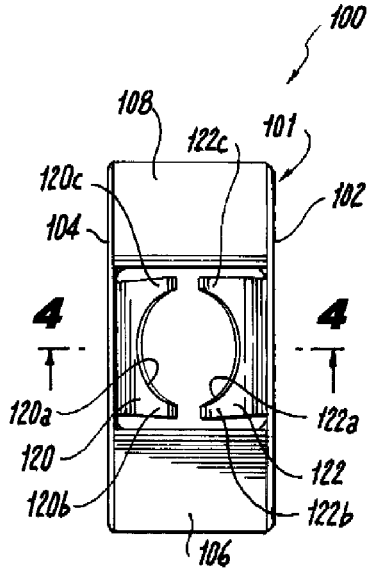
FIG. 3 illustrates a top plan view of the lower neck sizer shown in FIG. 2.
Figure 4:
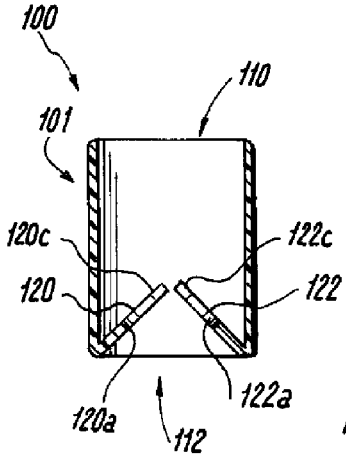
FIG. 4 illustrates a cross sectional view taken along line 4-4 of FIG. 3.

Referring now to FIG. 3, illustrated is a top plan view of the embodiment of the lower neck sizer 100 of FIG. 2. Seen through open upper surface 110 (not shown in FIG. 3) are first and second engagement tabs 120, 122, respectively. Generally, the engagement tabs on this and other embodiments serve to engage the hanger at a lower neck region. Each engagement tab 120, 122 has a relief 120*a*, 122*a*, respectively, and fingers 120*b*, 120*c*, and 122*b*, 122*c*. FIG. 4 illustrates a cross section of FIG. 3, taken along line 4-4, illustrating the position of tabs 120, 122.

In use, lower neck sizer 100 is passed over wire hook 30, with the wire hook 30 passing through both lower surface 112 and upper surface 110. Lower neck sizer 100 is brought to lower neck region 21. As the lower neck sizer 100 is pressed into engagement with the lower neck region 21, tabs 120, 122 deflect outward to admit projection 28 and first and second support flanges 32, 34. Once tabs 120, 122 are pressed beyond first and second support flanges 32, 34, tabs 120, 122 return to their original position. Relieves 120*a*, 122*a* cooperate to admit projection 28, while pairs of fingers 120*b*, 122*b*, and 120*c*, 122*c*, each locate in the space adjacent the intersection of projection 28 with first support flange 32 and the intersection of projection 28 with second support flange 34, respectively.

The first embodiment lower neck sizer 100 engages with lower neck region 21 at approximately the same level as or, slightly above body flange 22. Optionally, either or both of anterior wall 102 and posterior wall 104 may extend beyond body flange 22, at least to achieve a visual appearance consistent with further embodiments, below, or to combine additional features of those embodiments.

Figure 5:
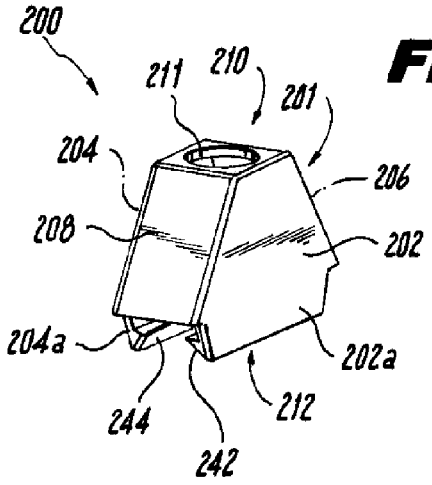
FIG. 5 illustrates, in perspective view, a lower neck sizer according to a second embodiment of the present invention.

Turning now to FIG. 5, illustrated in perspective view is a lower neck sizer, generally 200, according to a second embodiment of the present invention. A complete description of features in common with the first embodiment will be dispensed with. In contrast with the first embodiment, an upper surface 210 of lower neck sizer 200 is only partially open, and in this embodiment includes a round opening 211. This may be provided for aesthetic reasons, or may be sized to prevent the projection 28 from passing through the upper surface 210, to limit the downward movement of the lower neck sizer 200.

Lateral wall 208 will be sized to locate its lower edge above the body flange 22 of hanger 10, when positioned on a lower neck region 21. Either or both of anterior wall 202 and a generally trapezoidal posterior wall 204, in the second embodiment both, can have extensions 202*a*, 204*a*, respectively, dimensioned to extend beyond the body flange 22 of hanger 10, when positioned on a lower neck region 21. Either or both of extensions 202*a*, 204*a*, in the second embodiment both, can have inwardly directed tabs 242, 244, respectively. Notwithstanding the extensions 202*a*, 204*a*, anterior wall 202 and posterior wall 204 may still be considered generally trapezoidal.

Figure 6:
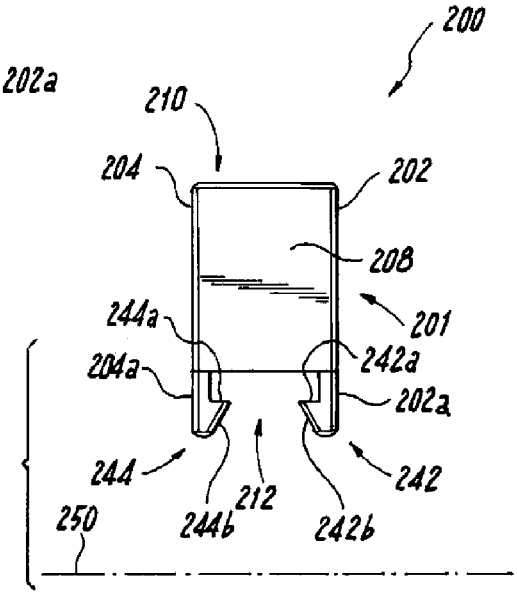
FIG. 6 illustrates a side view of the lower neck sizer shown in FIG. 5.

Turning now to FIG. 6, illustrated is a side view of the second embodiment of a lower neck sizer 200 shown in FIG. 5. Tabs 242, 244 have an upward surface 242*a*, 244*a*, respectively, and downward surface 242*b*, 244*b*, respectively, either or both of which may be sloped relative to a transverse datum 250. In the exemplary embodiment shown, tabs 242, 244 have a generally flat upward surfaces 242*a*, 244*a*, relative to transverse datum 250, which provides additional resistance to removal. Downward surfaces 242*b*, 244*b*, are sharply sloped relative to transverse datum 250, which reduces resistance and aids in ease of engagement with body flange 22. Inversely, where upward surfaces 242*a*, 244*a* sloped downward, resistance to removal would be reduced. Sloping downward is considered as having a distal point of tabs 242, 244 below the point of attachment to extensions 202*a*, 204*a*, respectively. Similarly, a reduced or eliminated upward slope of downward surfaces 242*b*, 244*b*, would increase resistance to engagement with body flange 22.

Tabs 242, 244 may be carried on an inward surface of extensions 202*a*, 204*a*, respectively, or at an end of the extensions 202*a*, 204*a*. In other words, extensions 202*a*, 204*a*, may continue beyond the minimum necessary to position tabs 242, 244 for engagement with body flange 22. Tabs 242, 244 may be coextensive with extensions 202*a*, 204*a*, respectively, or may be intermittent anywhere along the length of either extension, irrespective of the length, size, shape, or even presence of a tab on the opposite extension. Moreover, two extensions 202*a*, 204*a*, need not be provided. Alternately, the tabs 242, 244 may be provided in communication with anterior wall 202 and posterior wall 204 without any extension 202*a*, 204*a*. Such an embodiment is illustrated with reference to FIGS. 6A and 6B.

Figure 6A:
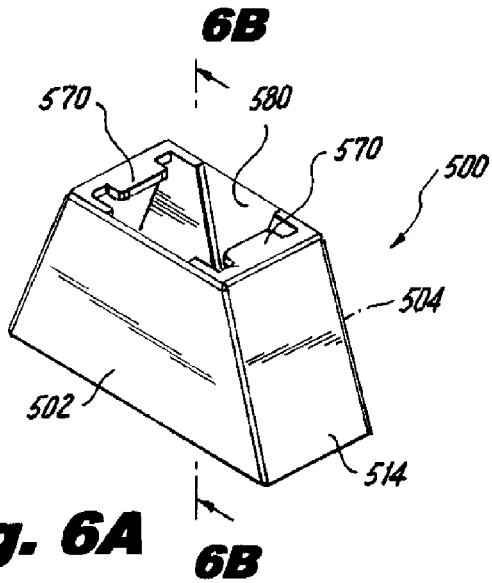
FIG. 6A illustrates a perspective view of further embodiment of a lower neck sizer.
Figure 6B:
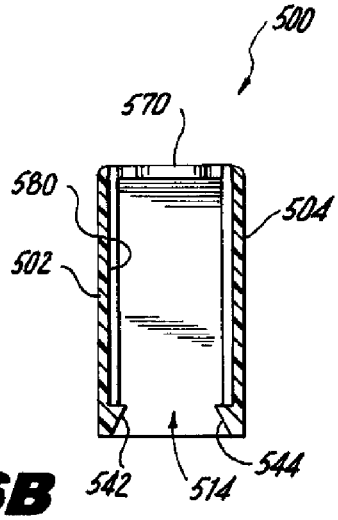
FIG. 6B illustrates a elevation cross sectional view taken along line 6B-6B of FIG. 6A.

FIG. 6A illustrates a perspective view of a lower neck sizer, generally 500. FIG. 6B illustrates an elevation cross sectional view taken along line 6B-6B of FIG. 6A. A detailed description of features this embodiment has in common with the foregoing embodiments, or those are otherwise readily apparent, will be dispensed with. In this embodiment of the sizer 500, fingers 570 extend horizontally from an end wall 514, and may be dimensioned to engage with the wire hook 30, or projection 28.

As shown in FIG. 6B, tabs 542, 544 extend from the inner surface of anterior wall 502 and posterior wall 504, respectively, generally adjacent a lower extent thereof. In addition, rather than engaging a body flange 22 of the hanger 10, a recess may be provided in projection 28 to receive and retain tabs 542, 544. Recess 580, if present, extends from an upper facing horizontal surface of the tabs 542, 544, and is typically formed by a portion of the mold used in the process of fabricating indicator 500 from an injection molded plastic material.

Figure 7:
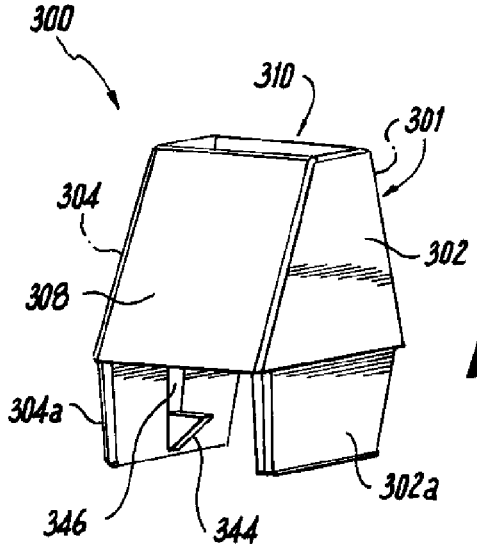
FIG. 7 illustrates, in perspective view, a third embodiment of the present invention.

For example, FIG. 7 illustrates a third embodiment of the present invention in perspective view. A complete description of features in common with the first embodiment will be dispensed with. It will be seen that tab 344 is shorter in both height and width than extension 304*a*. Also visible in FIG. 7 is a recess 346 in posterior wall 304. A similar recess may be present, but need not be, in the anterior or posterior walls of any embodiment of the present invention. For example a recess in anterior wall 104 is discernable through upper surface 110 in FIG. 2. It is formed by the intersection of mold halves, one of which may extend through the upper surface of the lower neck sizer during the molding process, when the lower neck sizer is formed of injection molded plastic.

In use, lower neck sizer 200 is passed over wire hook 30, with the wire hook 30 passing through both lower surface 212 and upper surface 210, through opening 211. Lower neck sizer 200 is brought to lower neck region 21. As the lower neck sizer 100 is pressed into engagement with the lower neck region 21, tabs 242, 244 deflect outward to admit body flange 22. Once tabs 242, 244 are pressed beyond flanges 22, tabs 242, 244 return to their original position. Tabs 242, 244, in cooperation with a lower extent of lateral walls 206, 208, and optionally with material surrounding opening 211, if present, hold the lower neck sizer 200 in engagement with lower neck region 21. The embodiment of FIG. 7 will be seen to operate similarly.

Figure 8:
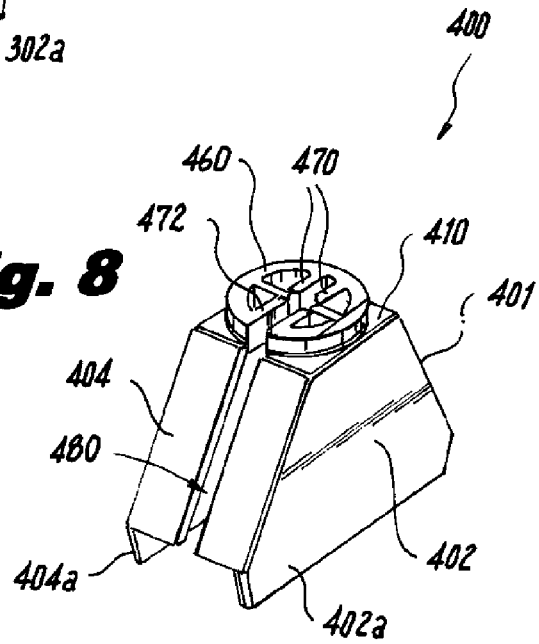
FIG. 8. illustrates, in perspective view, a lower neck sizer according to a fourth embodiment of the present invention.

Turning now to FIG. 8, illustrated in perspective view is a lower neck sizer, generally 400, according to a fourth embodiment of the present invention. A complete description of features in common with the foregoing embodiments will be dispensed with. Upper surface 410 includes a generally cylindrical band 460. The generally cylindrical band 460 can be circular, as in the illustrative embodiment, or another geometric cylindrical projection, including but not limited to rectangular, square, triangular, pentagonal, etc. In the fourth embodiment as shown, band 460 upwardly extends from the upper surface 410. Alternately or additionally, band 460 may extend downward from the upper surface 410, or may be eliminated altogether. Notwithstanding the presence, absence, or height of band 460 above or below upper surface 410, projections 470 may themselves extend in whole or in part above or below upper surface 410, or may be coplanar with it.

Lower neck sizer 400 also includes a plurality of substantially radial inwardly directed projections 470. At their mutual inward ends, projections 470 engage the wire hook 30 of the hanger 10. The inward ends 472 of projections 470 may be convex, as in the fourth embodiment, or may also be concave, or chamfered or sloped in any direction. With as few as two projections 470, concave ends lend stability to the fit between the projections 470 and the wire hook 30. Increasing numbers of projections aids stability and may obviate the need for concave ends.

Figure 9:
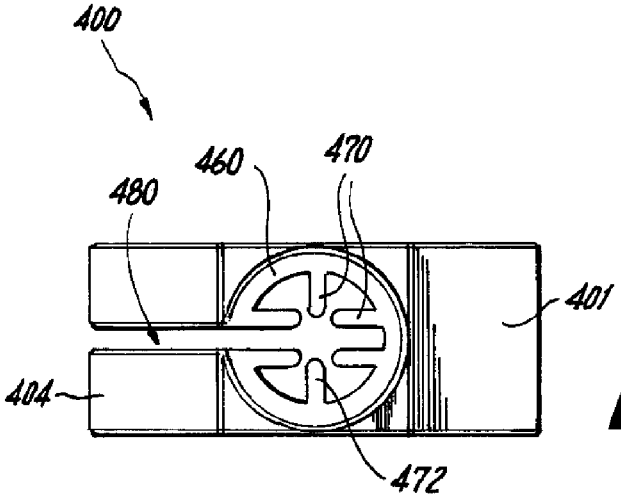
FIG. 9 illustrates a top plan view of the lower neck sizer shown in FIG. 8.

Optionally, the lower neck sizer 400 can have a discontinuity 480 traversing the height of the tab body 401 to facilitate mounting to a hanger by admitting the wire hook 30. The discontinuity 480 need be only as wide as necessary to allow the lower neck sizer 400 to admit the wire hook 30, and in fact may be narrower than the wire hook 30 where the material selected for lower neck sizer 400 can elastically deform to admit the wire hook 30. The ends of the discontinuity 480 may be radiused or chamfered to ease the insertion of the wire hook 30. Notwithstanding the discontinuity 480, the lower neck sizer 400 substantially surrounds the lower neck portion 21 of the hanger 10. FIG. 9 illustrates a top plan view of the fourth embodiment of a lower neck sizer 200 shown in FIG. 8.

Lower neck sizer 400 has extensions 402*a*, 404*a*, extending below walls 402 and 404, respectively, notwithstanding the absence of any tabs projecting from extensions 402*a*, 404*a*. Regardless, both projections 470 and such tabs may be provided to more securely engage the lower neck sizer 400 with the hanger 10. Similarly, a discontinuity 480 as included in the fourth embodiment may be incorporated into the previous embodiments to facilitate mounting the lower neck sizer to the hanger, regardless of the manner in which the particular lower neck sizer engages with the hanger.

In their preferred embodiments, lower neck sizers 100, 200, 300, 400 or 500 are integrally formed of a plastic material, more specifically, an injection molded plastic. The plastic can be flexible to accommodate resilient flexure for engagement with the hanger 10. Materials contemplated that satisfy this criterion of flexibility include, without limitation, polypropylene in its various forms, and K-resin in its various forms, among others.

Lower neck sizers 100, 200, 300, 400, or 500, or any parts thereof, can be configured to carry indicia selected in advance to correspond to the item to be suspended from the hanger. Categories of indicia could include manufacturer, material and price, but most notably for garments, their size. The indicia can have the form of numbers, letters or symbols either applied to the lower neck sizer and/or molded into it. Alternately or additionally the color, size, shape or mere presence of the lower neck sizer itself may be the indicia.

The present invention has been described with respect to certain exemplary embodiments. Certain alterations and/or modifications will be apparent to those skilled in the art, in light of the instant disclosure, without departing from the spirit or the scope of the invention. These embodiments are offered as merely illustrative, and not limiting, on the scope of the invention, which is defined solely with reference to the following appended claims.

I claim:

1. A lower neck sizer for a hanger, comprising:

a sizer body configured to generally surround a lower neck portion of the hanger, the body comprising an anterior wall, a posterior wall substantially parallel to the anterior wall and a pair of lateral walls connecting the anterior wall and the posterior wall, respectively, to define a substantially trapezoidal profile of the sizer body, the anterior wall, the posterior wall and the lateral walls collectively defining a top opening in a first plane and a bottom opening in a second plane substantially parallel to the first plane;

at least one downward extension extending from the anterior wall or the posterior wall, the downward extension comprising a recess; and an inwardly extending tab secured to the downward extension and located at the lower edge of the recess, the inwardly extending tab configured to engage the hanger at a lower neck region and resist removal of the lower neck sizer.

2. The lower neck sizer according to claim 1, wherein the inwardly extending tab comprises an upward surface located to engage a body flange of the hanger.

3. The lower neck sizer according to claim 1, wherein the lower neck sizer comprises an injection molded plastic.

4. The lower neck sizer according to claim 3, wherein the injection molded plastic comprises one or more of a polypropylene, and a K-resin.

5. The lower neck sizer according to claim 1, wherein the lower neck sizer carries predetermined indicia which corresponds to an item to be suspended from a hanger.

6. The lower neck sizer according to claim 5, wherein the indicia comprises one or more of the color of the lower neck sizer, the size of the lower neck sizer, the shape of the lower neck sizer, symbols applied to the lower neck sizer, or symbols molded into the lower neck sizer.

7. The lower neck sizer according to claim 1, wherein the inwardly extending tab has a height which is smaller than the height of the downward extension and wherein the inwardly extending tab has a width which is smaller than the width of the downward extension.

8. A combination of a turnable wire hook hanger and a lower neck sizer, the turnable wire hook hanger comprising:

a body having a body flange surrounding the body;

a cylindrical projection extending from the body beyond the flange;

a pair of support flanges extending between the cylindrical projection and the body flange; and a wire hook rotatably received in the cylindrical projection; and the lower neck sizer comprising:

a body dimensioned to generally surround the cylindrical projection and the support flanges adjacent to the body flange, the body comprising an anterior wall, a posterior wall substantially parallel to the anterior wall and a pair of lateral walls connecting the anterior wall and the posterior wall, respectively, to define a substantially trapezoidal profile of the sizer body, the anterior wall, the posterior wall and the lateral walls collectively defining a top opening in a first plane and a bottom opening in a second plane substantially parallel to the first plane;

at least one downward extension extending from the anterior wall or the posterior wall, the downward extension comprising a recess; and an inwardly extending tab secured to the downward extension and located at the lower edge of the recess, the inwardly extending tab configured to engage the hanger at a lower neck region to resist removal of the lower neck sizer.

9. The combination according to claim 8, wherein the inwardly extending tab comprises an upward surface located to engage the body flange.

10. The combination according to claim 8, wherein the lower neck sizer comprises an injection molded plastic.

11. The combination according to claim 10, wherein the injection molded plastic comprises one or more of a polypropylene, and a K-resin.

12. The combination according to claim 8, wherein the lower neck sizer carries predetermined indicia which corresponds to an item to be suspended from the hanger.

13. The combination according to claim 12, wherein the indicia comprises one or more of the color of the lower neck sizer, the size of the lower neck sizer, the shape of the lower neck sizer, symbols applied to the lower neck sizer, or symbols molded into the lower neck sizer.

14. The combination according to claim 8, wherein the inwardly extending tab has a height which is smaller than the height of the downward extension and wherein the inwardly extending tab has a width which is smaller than the width of the downward extension.

* * * * *